US006604328B1

(12) United States Patent
Paddock

(10) Patent No.: US 6,604,328 B1
(45) Date of Patent: Aug. 12, 2003

(54) PORTABLE CABIN, COMPONENTS THEREFOR, METHODS OF MAKING AND ERECTING SAME

(76) Inventor: David R. Paddock, 30560 Utica Dr., Richland, MO (US) 65556

( * ) Notice: Subject to any disclaimer, the term of this patent is extended or adjusted under 35 U.S.C. 154(b) by 107 days.

(21) Appl. No.: 09/951,045

(22) Filed: Sep. 12, 2001

(51) Int. Cl.[7] ..... E04H 1/00

(52) U.S. Cl. ..... 52/93.1; 52/90.1; 52/79.9; 52/270; 52/264

(58) Field of Search ..... 52/143, 270, 745.05, 52/79.1, 79.9, 90.1, 93.1, 223.7, 264, 284, 783.1, 794.1

(56) References Cited

U.S. PATENT DOCUMENTS

| | | | | | |
|---|---|---|---|---|---|
| D245,106 | S | | 7/1977 | Scheid | |
| 4,633,626 | A | | 1/1987 | Freeman et al. | |
| 4,637,179 | A | | 1/1987 | Bigelow, Jr. et al. | |
| 4,891,919 | A | | 1/1990 | Palibroda | |
| 4,910,938 | A | | 3/1990 | McGee | |
| 5,152,114 | A | * | 10/1992 | Beazley et al. | 52/264 |
| 5,287,675 | A | | 2/1994 | McGee | |
| 5,447,000 | A | * | 9/1995 | Larsen | 52/79.1 |
| 5,660,005 | A | | 8/1997 | Tacoma | |
| 5,706,620 | A | * | 1/1998 | De Zen | 52/220.2 |
| D392,054 | S | | 3/1998 | McGee et al. | |
| 5,755,062 | A | | 5/1998 | Slater | |
| 5,864,992 | A | | 2/1999 | Bigelow | |
| 5,970,672 | A | * | 10/1999 | Robinson | 52/270 |
| 6,006,480 | A | * | 12/1999 | Rook | 52/309.12 |
| 6,085,470 | A | | 7/2000 | Bigelow | |
| 6,088,969 | A | | 7/2000 | Bigelow | |
| 6,195,950 | B1 | * | 3/2001 | Harris | 52/270 |
| 6,219,971 | B1 | * | 4/2001 | Headrick | 49/469 |
| 6,494,013 | B2 | * | 12/2002 | Winskye | 52/745.01 |

* cited by examiner

*Primary Examiner*—Carl D. Friedman
*Assistant Examiner*—Jennifer I. Thissell
(74) *Attorney, Agent, or Firm*—Richard L. Marsh

(57) ABSTRACT

A portable building comprising wall panels, studs, floor panels, floor support members, roof panels, truss members may be transported in the bed of a pickup truck, erected on one building site, used for living quarters at the site, disassembled at the one building site, transported in the pickup truck to a new site and erected on the new site. Erection of the portable building is easily accomplished in less than six man-hours. The portable building will withstand a side load equivalent to an 80 mile per hour wind and a roof load of 40 pounds per square foot.

10 Claims, 6 Drawing Sheets

81
78
133
21
81
149
27

80
148
104
80
77
20

15
153
147
155
154
156
160
158
159
40
40
48

FIG. 10
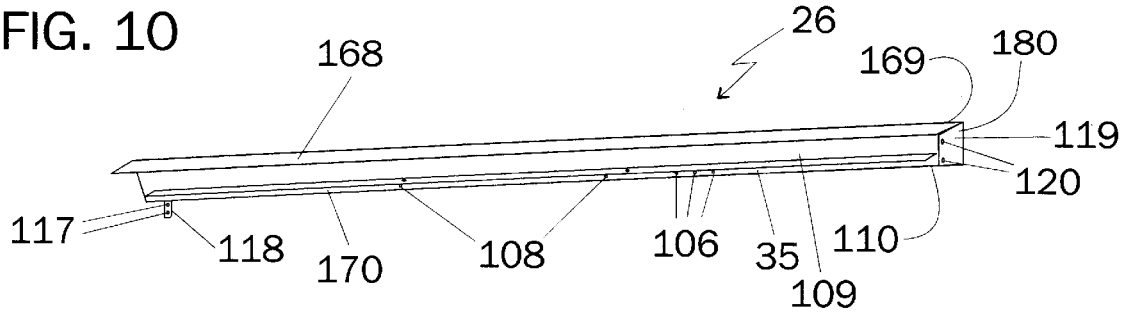
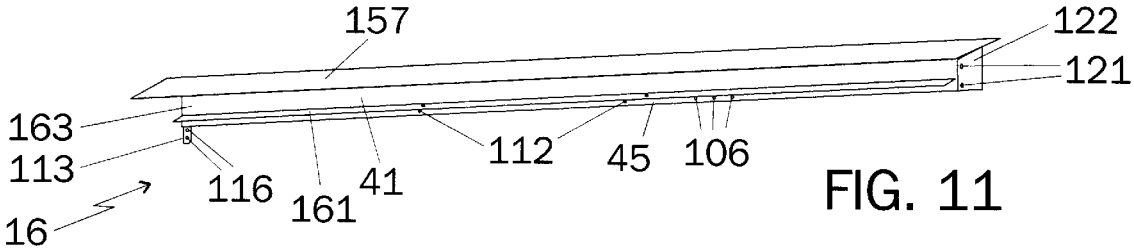
FIG. 11
FIG. 12
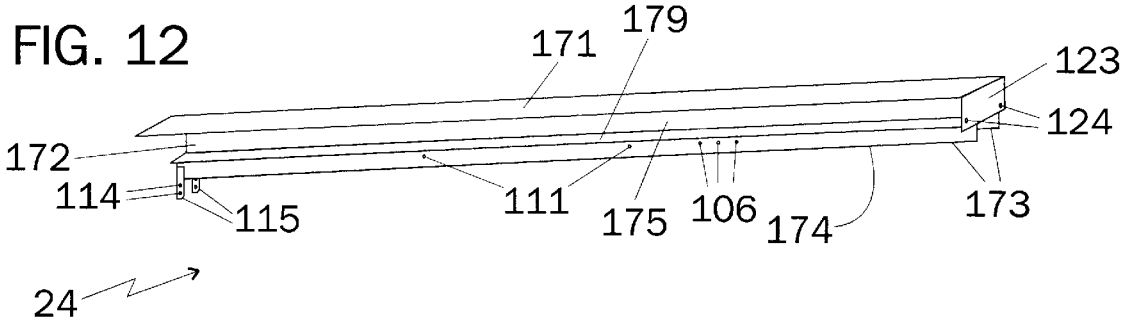
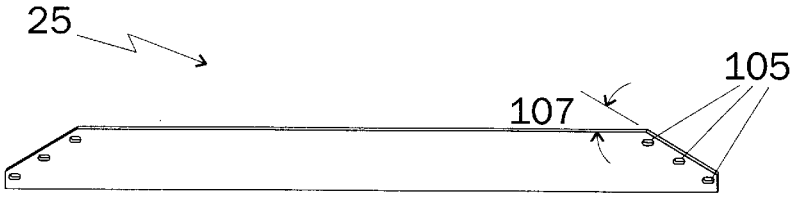
FIG. 13
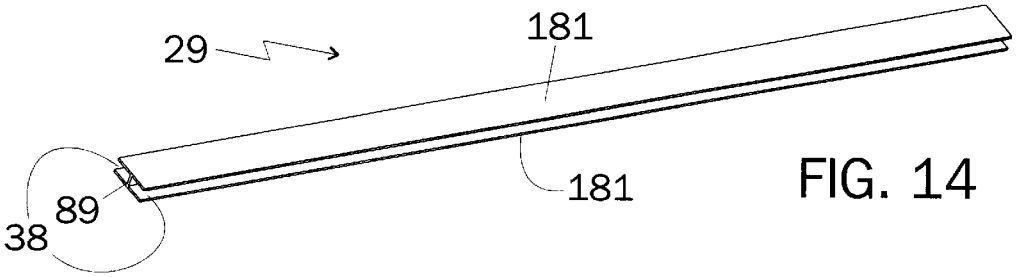
FIG. 14

PORTABLE CABIN, COMPONENTS THEREFOR, METHODS OF MAKING AND ERECTING SAME

BACKGROUND OF THE INVENTION

1. Field of the Invention

This invention relates to a building which can be carried in disassembled fashion in the bed of a pickup truck, erected on a building site, used for living quarters at the building site, disassembled and stored for transportation in a pickup truck.

2. Prior Art Statement

Numerous portable structures have been used by people for all time. Tents and Teepee have been used throughout the ages while newer portable buildings have rigid or semi rigid walls. Some portable buildings are transported enmass, that is, the structure is complete and transported by truck or rail while others are adapted to be permanently erected on site once all the materials are assembled. Most portable buildings require numerous screws, nails, bolts, hinges and hinge pins requiring power tools and several people many man-hours to assemble. Typical examples of these buildings are recited in the following prior art.

It is known to provide a plurality of wall panels hinged to adjacent panels or joining columns and additionally hinged to the floor wherein truss members are erected between the walls to form a roof support with additional panels joined together as roof elements. All panels have channels at the edges thereof which carry sealing gaskets. For instance, see the U.S. Pat. No. 4,633,626 issued on Jan. 6, 1987, to Freeman, et al. Hundreds of screws are required to attach the hinges and locks to the panels.

It is also known to provide a basic box-like habitable unit built on a rectangular angle iron frame which then can be lifted with crane hooks. Lag screws and nails are necessary for assembly. No doors or windows are provided making access to the living quarters quite difficult. Once assembled, these buildings are moved as completed units. For instance, see the U.S. Pat. No. 4,637,179 issued on Jan. 20, 1987 to Bigelow, Jr., et al.

It is further known to provide a containerized shipping container as part of the structure of this building wherein some of the panels are hinged to the container frame while others are removed therefrom and assembled by interlocking numbered panels together. All the composite panels are stored within the container. It is stated that hardboard siding is added to the exterior. For instance, see U.S. Pat. No. 4,891,919 issued on Jan. 09, 1990 to James W. Palibroda.

It is well known to provide panel members for mounting wall and ceiling panels wherein the panel members having receiving slots for the panels. For instance see the U.S. Des. Pat. No. 245,106 to Lloyd J. Scheid issued on Jul. 19, 1977.

Additionally, it is known to provide a multiple channel aluminum extruded wall stud for an in-plant portable, relocatable modular building which captures the laminated wall structures on either side of a central support of the stud. Separate inside and outside channels comprise the stud and must be assembled from opposite sides of the wall. These buildings are adapted for erection on an existing floor surface and are generally placed within another building such as a warehouse. For instance, see U.S. Pat. No. 4,910,938 issued on Mar. 27, 1990 to Jerry V. McGee and the U.S. Pat. No. 5,287,675 issued on Feb. 22, 1994 to Wayne R. McGee.

Another known portable building comprises a frame work structure assembled by slipping light gage box beams into formed receivers and bolting the structure together. Fabric is then stretched over the frame. The upright posts may be telescoping to accommodate uneven ground or alter the height of the building. This structure requires a great number of small bolts, screws, rivets or the like. It is stated that insulation panels comprising a foam core with dent resistant skins on opposite sides may be used in the roof and/or walls. For instance, see U.S. Pat. No. 5,660,005 issued on Aug. 26, 1997 to Michael T. Tacoma.

McGee, et al., in U.S. Des. Pat. No. 392,054 provide a one piece stud for the aforementioned modular building wherein it is presumed that wall panels are captured between the longer and shorter wings.

Yet another known portable structure comprises metal sheets welded to channels separating inner and outer skins by six inches. The space between the inner and outer skins is filled with "light weight concrete." Using ¼ inch steel for all skins an 8×8×8 building would weigh several tons including the concrete. These buildings are lifted by a crane and transported by heavy duty truck in order to relocate. For instance see the U.S. Pat. No. 5,755,062 issued on May. 26, 1998 to Electus P. Slater.

Finally, William H. Bigelow in his U.S. Pat. Nos. 5,864,992, 6,085,470, 6,088,969 issued on Feb. 2, 1999, Jul. 11, 2000 and Jul. 18, 2000 respectively, provides a portable building comprising a plurality of interconnected walls having a roof structure thereover wherein the walls and/or the roof structure are made of a flexible elastomeric material. No means for erecting the building is specifically recited.

SUMMARY OF THE INVENTION

The portable buildings in the prior art are generally intended to be transported to a first site, erected thereon and either left standing there or transported enmass to a new site. Most require a multi-person building crew at least one day and in many instances several days to erect. Few, if any, however, may be transported in the bed of a pickup truck, erected on a building site, used for living quarters at the site and thereafter be disassembled and transported in the pickup truck to a new site wherein the entire erection process may be completed within hours. Therefore, it is an object of this invention to provide a portable building comprising a plurality of wall panels, a plurality of upright studs, a plurality of floor panels, a plurality of floor support members, a plurality of roof panels, a plurality of truss members wherein each edge of the plurality of wall panels is captured in a channel in one of the plurality of upright studs, the plurality of floor panels supported on the plurality of floor support members, the plurality of roof panels is supported on the plurality of truss members and wherein the building has at least one elongated fastener passing through at least two of the plurality of upright studs.

It is another object of this invention to provide a portable building comprising a plurality of wall panels, a plurality of upright studs, a plurality of floor panels, a plurality of floor support members, a plurality of roof panels, a plurality of truss members and at least one elongated fastener passing through at least two of the plurality of truss members.

BRIEF DESCRIPTION OF THE DRAWINGS

FIG. 10 is a enlarged perspective view of an end rafter of the portable building of FIG. 1.

FIG. 11 is a enlarged perspective view of an intermediate rafter of the portable building of FIG. 1.

FIG. 12 is a enlarged perspective view of a room divider rafter of the portable building of FIG. 1.

FIG. 13 is a enlarged perspective view of a collar tie for the roof truss of the portable building of FIG. 1.

FIG. 14 is a enlarged perspective view of a floor joint for the portable building of FIG. 1.

DESCRIPTION OF THE PREFERRED EMBODIMENTS

While the various features of this invention are hereinafter described and illustrated as a portable building comprising a plurality of wall panels, a plurality of upright studs, a plurality of floor panels, a plurality of floor support members, a plurality of roof panels, a plurality of rafters and a plurality of truss members wherein each edge of the plurality of wall panels is captured in a channel in one of the plurality of upright studs, the plurality of floor panels supported on the plurality of floor support members, the plurality of roof panels supported in a channel in the plurality of rafters, the plurality of rafters joined together by the plurality of truss members, it is to be understood that the various features of this invention can be used singly or in various combinations thereof to provide a portable building adapted for transport in the bed of a pickup truck, erected on a building site, used for living quarters at the site and thereafter be disassembled and transported in the pickup truck to a new site wherein the entire erection process may be completed within hours as can hereinafter be appreciated from a reading of the following description.

Figure 1:
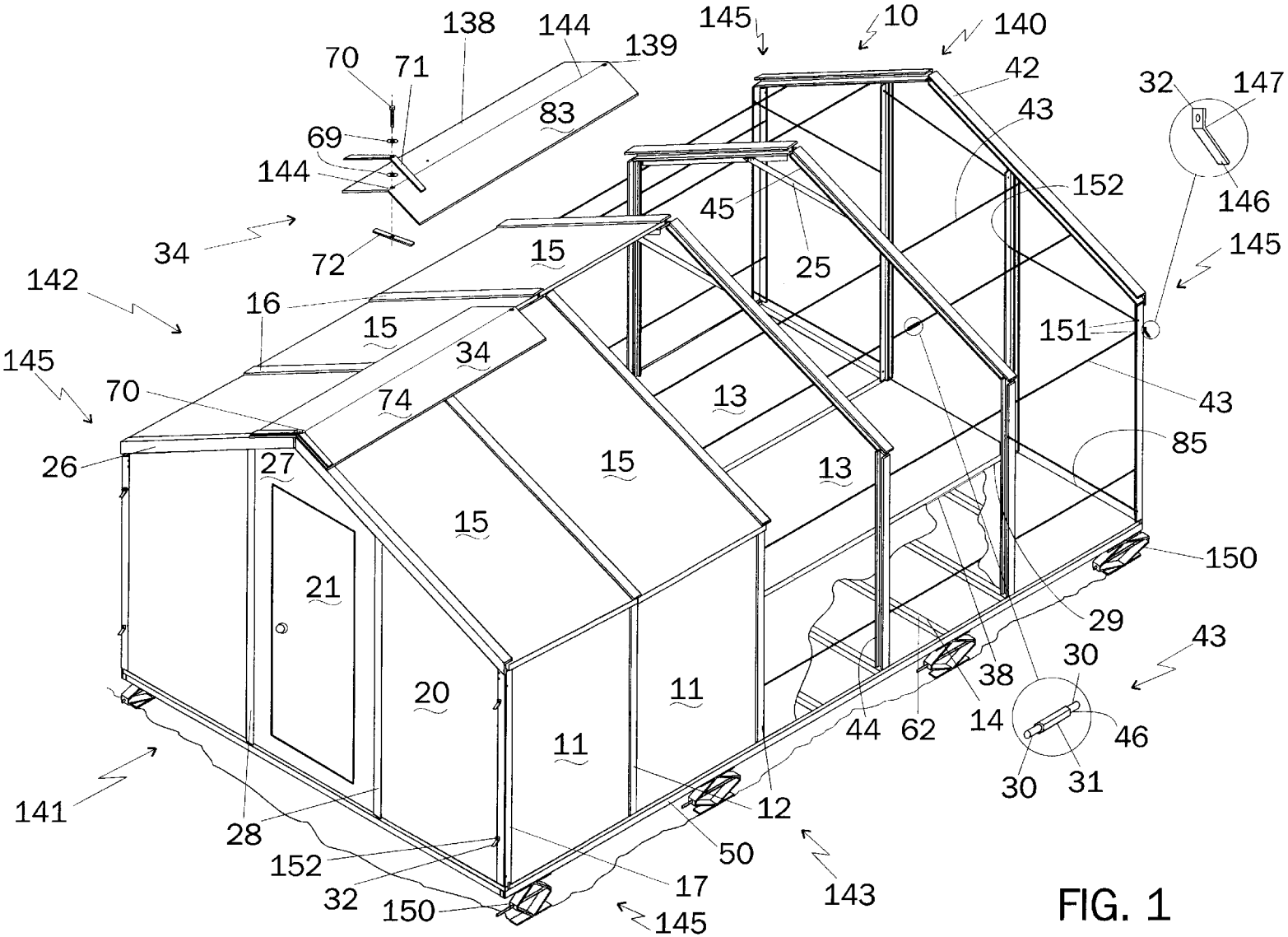
FIG. 1 is a perspective view of the portable building of this invention with some parts removed and some sections broken away to expose hidden features.
Figure 3:
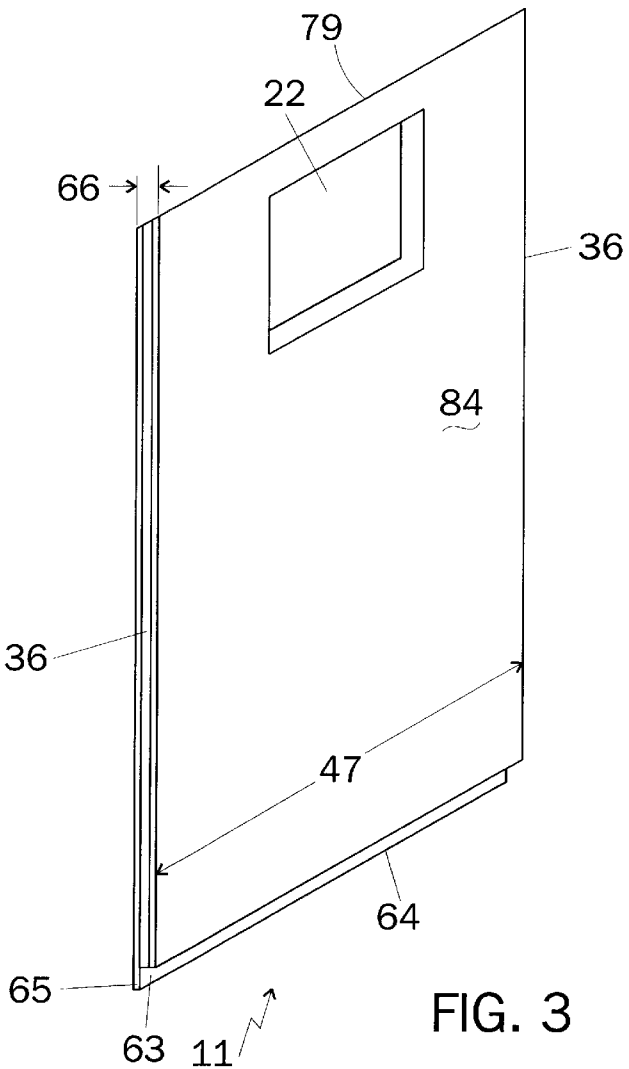
FIG. 3 is an enlarged view of a wall panel of the portable building of FIG. 1 having a window disposed therein.

Referring now to FIGS. 1 through 18, a portable building in FIG. 1 generally described by the numeral 10 comprises a pair of rim joists 50, plurality of wall panels 11, a plurality of end panels 20, 27, a plurality of upright posts or studs 12, 28, a plurality of floor panels 13, a plurality of floor joints 29, a plurality of floor support members 14, a plurality of roof panels 15, a plurality of rafters 16, 26, a plurality of collar ties 25, said plurality of rafters 16, 26 and said plurality of collar ties 25 comprising a plurality of truss members 82, and a plurality of elongated fasteners 43. In FIG. 1, some wall panels 11, roof panels 15, roof rafters 16, 26 and wall studs 12 have been removed to show internal details of portable building 10. At least one side edge 36 of each wall panel 11 is captured in a channel 37 in upright stud 12 and at least one side edge 80 of each corner end panel 20 and at least one side edge 81 of center end panel 27 are likewise captured in a channel of end posts 28. Floor panels 13 are supported on floor support members 14 and separated by floor joint members 29. Edges 38 of floor panels 13 are captured in channels 39 in floor joint members 29, floor joint members 29 providing a smooth transition from one floor panel 13 to an adjacent floor panel 13. Preferably, floor joint members 29 are recessed into upper edge 62 of floor supports 14 such that floor panels 13 lie flat upon upper edge 62 of floor supports 14 and sockets or U-shaped brackets 49. At least one edge 40 of each roof panel 15 is received in a channel 41 in each intermediate rafter 16, intermediate rafters 16 joined together in pairs by a collar tie 25 thus forming truss 82 spanning across portable building 10 from one upright stud 12 to an upright stud 12 directly across portable building 10. In the preferred embodiment shown in FIG. 1, portable building 10 has rafters 16, 26 held in spaced relationship by roof panels 15 and at least one elongated fastener 43 passing through a web 45, 35 of each rafter 16, 26. Similarly, studs 12, 28 also have at least one elongated fastener 43 passing through a web 44 of each upright stud 12, 28, fastener 43 adapted to be tightened on at least one end 151, 152 thereof with a wrench nut 32 thus holding wall panels 11 between adjacent upright studs 12, 28. Preferably, both ends 151, 152 of fastener 43 have wrench nut 32 fitted thereon to assist in squaring portable building 10 during erection thereof. Each elongated fastener 43 preferably comprises a plurality of sections 30 of rod threaded on both ends 51, 52 and a plurality of coupling nuts 31, coupling nuts 31 joining adjacent sections 30 at end 51 of one section 30 to end 52 of the adjacent section 30 thereof, ends 51, 52 threaded into ends 46 of coupling nuts 31. Wall panels 11 are preferably substantially four feet in width 47 and thus, when wrench nuts 32 are tightened to clamp wall panels 11 between studs 12, the distance between centers of webs 44 is substantially equal to four feet which is also the distance between alternate ones of floor supports 14, floor supports 14 spaced on two-foot centers by U-shaped brackets 49 joined to a rim joist plate 50 wherein upright posts 12 are affixed to alternate ones of floor support members 14 and rim joist 50. Upright posts 12, 28, 23 each have an elongated lag bolt passing through an appended tab 91, 100, 130, respectively, on the lower end 93, 97, 182, respectively thereof and through a preformed hole 96 in rim joist 50 into the aforementioned alternate ones of floor support members 14 thus affixing posts 12, 23, 28 to rim joist 50.

Figure 2:
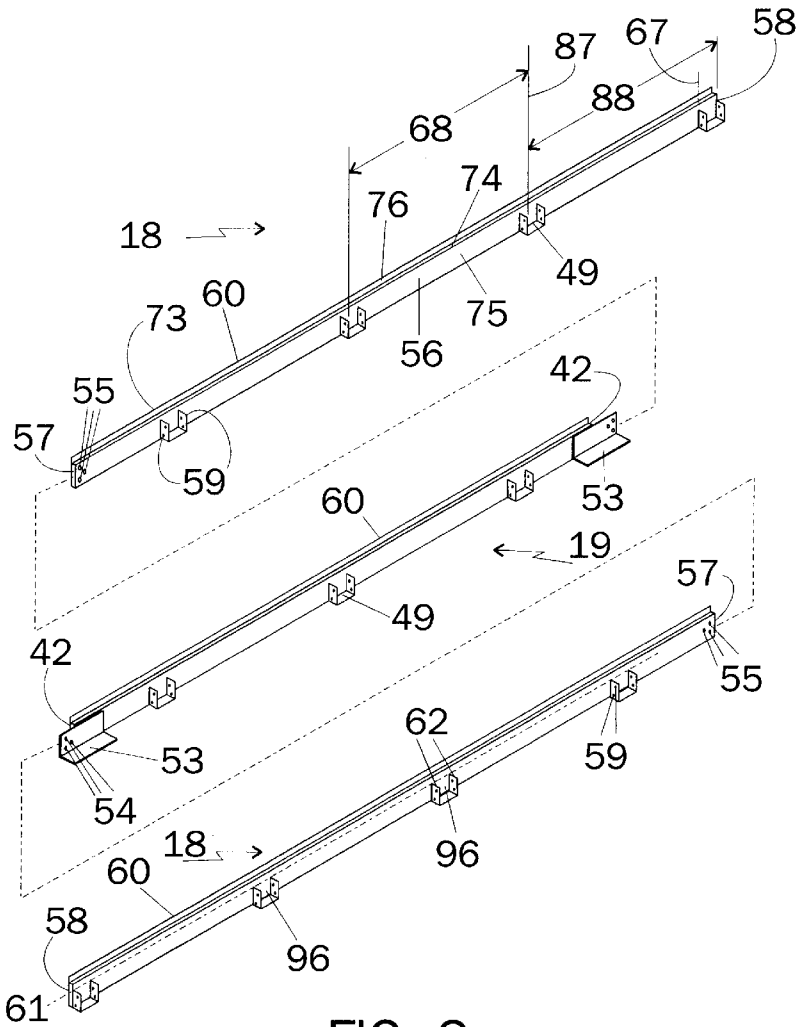
FIG. 2 is an enlarged perspective view of the preferred embodiment of the rim joist of the building of FIG. 1.

Referring now specifically to FIG. 2, in the preferred embodiment for a 12' by 20' portable building 10, rim joist 50 comprises a center base plate 19 and two end base plates 18, end base plates 18 identical but opposite in construction. Each end 42 of center base plate 19 has a lap bracket 53 welded thereto, lap bracket 53 adapted to be joined to an adjacent end base plate 18 by one inch long ¼–20 UNC bolts passed through holes 54 in lap bracket 53 aligned with bolt holes 55 in end base plate 18. Lap bracket 53 is preferably fitted to the inside surface 56 of center base plate 19 and extends beyond ends 42 thereof such that internal ends 57 of end base plates 18 abut ends 42 of center base plate 19.

U-shaped brackets 49 are disposed on inside surface 56 of rim joist 50, sockets 49 adapted to receive floor support members 14 therein. Open ends 58 of end base plates 18 each carry a floor support beam 14 in the terminal U-shaped bracket 49 thereof and thus open ends 58 and terminal-support beam 14 define the ends 140, 141 of portable building 10. Two rim joists 50 are used in portable building 10 in opposing relationship wherein U-shaped brackets 49 of a left side rim joist 50 are arranged directly opposite U-shaped brackets 49 in a right side rim joist 50. Floor supports 14 are laid into the opposing pairs of U-shaped brackets 49 and extend therebetween with U-shaped brackets 49 of each opposing pair firmly attached to its respective floor support 14 supported therein by screws through holes 59 in U-shaped brackets 49. Thus, floor panels 13 are supported on floor support members 14, wherein floor support members 14 are supported in receiving sockets 49 affixed to rim joist plate 50 extending along opposing sides 142, 143 of portable building 10. Upper edge 60 of rim joist 50 is spaced from a plane 61 lying across the upper edge 62 of floor supports 14 and U-shaped brackets 49 to retain the bottom flange 63 of the lower edge 64 of wall panel 11 between rim joist 50 and floor panels 13. Upper edge 60 of rim joist 50 is provided on end base plates 18 and center base plate 19 by affixing a 1 and ½ inch wide, ⅛" thick strap 76 on the exterior surface 73 of the four inch wide, ¼" thick steel plate 75 of base plates 18, 19, wherein the strap 76 has upper edge 60 disposed about ½" above an upper edge 74 of steel plate 75. Thus, when floor panels 13 are laid on floor supports 14, a space equal to the thickness of the outer skin 65 of wall panel 11 is provided between outer edge 38 of floor panels 13 and strap 76 of rim joist 50. As will become readily apparent from the reading of this specification, bottom flanges 63 of side wall panels 11 are captured between outer edge 38 of floor panels 13 and strap 76 and bottom flanges 77, 78 respectively of end panels 20, 27 extend below the edge of floor panels 13 thus providing significant side load support to portable building 10.

End base plates 18 and center base plates 19 are preferably constructed of 4 inch wide, ¼" thick steel plate having ⅛" thick U-shaped brackets 49 welded to inside surface 56 at spaced locations along base plates 18, 19. Preferably, end base plates 18 have one U-shaped bracket 49 welded to inside surface 56 at open end 58 with center line 67 of U-shaped bracket 49 spaced from open end 58 a distance equal to the thickness of wall of U-shaped bracket 49 plus one half the width of floor support 14 and center line 87 of next inboard U-shaped bracket 49 spaced from end 58 about 2 feet as shown at 88. Subsequent U-shaped brackets 49 are spaced along end base plate 18 substantially on two foot centers as shown at numeral 68, and when joined with center base plate 19 and opposite end base plate 18, all U-shaped brackets 49 are thus substantially spaced on two foot centers to provide for the twenty foot length of the preferred embodiment of portable building 10. U-shaped brackets 49 are preferably formed from ⅛" thick steel channel and extend from inside surface 56 approximately 2 inches providing ample support for floor supports 14. As floor supports 14 and floor panels 13 are preferably purchased locally by the owner of a particular portable building 10, these items are used at the stock width provided by local lumber companies. Floor supports 14 are preferably purchased as 12' long stock 4×4 pressure treated timbers and floor panels 13 are 4'×8' rectangular or 4'×4' square, ⅝" thick plywood or chipboard panels or a combination thereof as desired by the owner.

In beginning construction of portable building 10, floor supports 14 are fixed into U-shaped brackets in rim joists 50 and then leveled from one rim joist 50 to the other rim joist 50 by placing leveling jacks 150 under U-shaped bracket 49 at each end 57, 58 of end base plates 18 and under lap brackets 53 with jacks 150 placed adjacent rim joists 50. Preferably another leveling jack 150 is placed under each floor support 14 thus supported by leveling jacks 150 at rim joists 50 at a mid point between rim joists 50. For a 12' by 20' building, four end base plates 18, two center base plates 19, eleven floor supports 14 and twelve leveling jacks 150 are laid out in a rectangle at the building site with floor supports 14 firmly attached to rim joists 50. It would be possible to place at least one part of at least one of rim joists 50 directly upon the surface of erection, however, it is preferred that at least the twelve leveling jacks 150 hereinbefore mentioned are used. Referring to FIG. 1, it is observed that one leveling jack 150 is placed upon the surface of erection at one corner 145, this leveling jack 150 substantially fully collapsed where rim joist 50 is closest to the surface of erection while other leveling jacks 150 at other corners 145 and on floor supports 24 are shown in various extended positions to level portable building 10.

Of course, it is within the scope of this invention to prepare a level base for portable building 10, such as a concrete slab or a level graded earthen or crushed rock area, and erect portable building thereon. When a concrete slab is used, provisions for attaching upright studs 12, 28 and corner posts 17 may be disposed in the edge of the concrete slab and/or rim joists 50 may be used as the upper, outer edges of the slab. Also, when a level graded area is used, it is usually unnecessary to use jacks 150 unless it is desired to raise portable building 10 above the surface of the graded area. Once leveled, floor panels 13 are laid transversely across floor supports 14 in grooves provided in floor supports 14 with floor joints 29 disposed between each of floor panels 13. As hereinbefore described, floor panels 13 are spaced from inside surface 56 of rim joists 50 only slightly as the thickness of outer skin 65 of wall 11 is preferably made with ⅜" plywood and a major portion thereof rests upon upper surface 74 of plate 75. It is apparent here, that side wall panels 11 have an outer structural skin 65 extending below bottom surface 64 thereof adapted to be captured between outer rim strap 76 of rim joist 50 and a contiguous one of floor panels 13 and wherein inner structural skin 158 is adapted to rest on an upper surface of the one floor panel 13. Adding the width of the three floor panels 13 and allowing for the thickness of web 89 of floor joint 29 and the spacing of floor panels 13 from inside surface 56, rim joists 50 are spaced apart slightly more than twelve feet.

Figure 9:
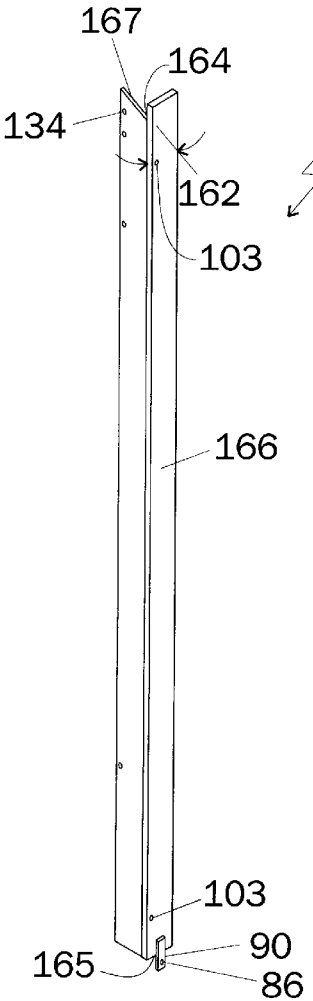
FIG. 9 is a enlarged perspective view of a corner post of the portable building of FIG. 1.
Figure 16:
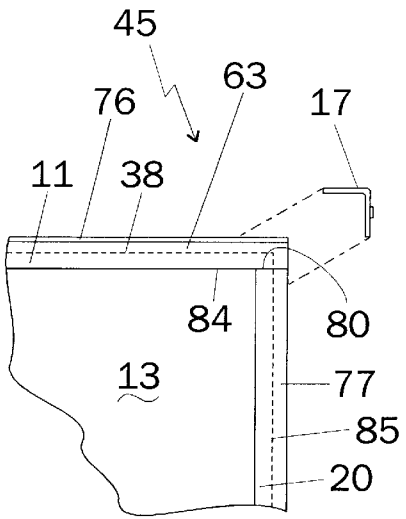
FIG. 16 is a greatly enlarged partial top plan view of one corner of the portable building of FIG. 1 during erection thereof.

Referring now to FIGS. 3, 4, 5 and 16, one side panel 11 and one corner end panel 20 are set upon floor member 13 with flange 63 of side panel 11 captured between an outside edge 38 of floor Member 13 and strap 76 while flange 77 of corner end panel 20 abuts against an end 85 of floor member 13, this juncture against floor member 13 shown with dashed lines in FIG. 16. Corner end panel 20 has side edge 80 placed adjacent and contiguous with inside surface 84 of side panel 11 and is affixed thereto with at least one wood screw driven through wall panel 11 into side edge 80 of corner end panel 20 to hold side panel 11 and corner end panel 20 in an upright manner while construction continues. Comer post 17 may then be moved into position around this first corner 145 as shown with dot-dash lines and affixed to end floor support 14 with a lag screw driven through hole 86 in tab 90 of corner post 17. Usually, however, corner post 17 is applied to wall panels 11, 20 after construction of all wall panels 11 on one side 142 and at least corner end panel 20. Construction may proceed along side 142 of portable building 10 by sliding channel 37 of wall stud 12 over exposed side edge 36 of side wall panel 11, resting bottom end 93 upon floor member 13 and affixing tab 91 to rim joist 50 and floor support 14 by driving a lag screw through hole 92 in tab 91, through hole 96 in rim joist 50 and into floor support 14. Another wall panel 11 may then be fitted into the exposed channel 37 of stud 12 with depending flange 63 captured between strap 76 and floor member 13. Thereafter, another stud 12 is slid over the exposed side edge 36 and affixed to rim joist 50 and the respective floor support 14. This process is repeated until all side wall panels 11 of side 142 are standing. Referring also to FIGS. 7, 8 and 9, completion of construction of end 140 previously begun may proceed by resting bottom 97 of end post 28 upon floor member 13 and sliding exposed edge 80 of corner end panel 20 in to channel 98 of end post 28. End post 28 is then joined to floor support 14 by driving a lag screw through hole 101 in depending tab 100 and into floor support 14. One side edge 81 of center end panel 27 is then placed into the exposed channel 98 of end post 28 with depending flange 78 abutting end 85 of floor member 13 in the same manner as corner end panel 20. Another end post 28 is added to the exposed edge 81 of center end panel 27 and this end post 28 is also fixed to floor support 14. Another corner end panel 20 of opposing top angle 104 is joined to end post 28 to complete end 140 of portable building 10. The remaining side wall 143 and remaining end 141 are then constructed in the same manner as recited for the two standing walls 140, 142. Thus, each corner 145 of portable building 10 has wood screws passing through side wall panel 11 at each corner 145 into the contiguous corner end panel 20. Corner posts 17 are then arranged around each corner 145 of portable building 10 and affixed to floor supports 14 through holes 96 in rim joists 50 with lag screws.

Elongated fasteners 43 are then passed through holes 103 of corner posts 17, through side wall panel 11 and through holes 102 in flange 97 of end posts 28 with a wrench nut provided at both ends 151, 152 thereof One elongated fastener 43 passes through holes 102 in both end posts 28 and both corner posts 17 below door 21 and thus secures ends 140, 141 together. Two other elongated fasteners 43 are passed through holes 102 in corner posts 17 and holes 102 about half way along the length of end posts 28 and secured against flanges 99 of end posts 28 with either standard nuts or the threaded portion of wrench nuts 32 on both ends 151, 152 thereof. Additional elongated fasteners 43 are passed through holes 94 in each stud, holes 94 aligned from end 140 to 141 of portable building 10. Wrench nuts 32 are fitted on opposing terminal ends 151, 152 of elongated fasteners 43. As hereinbefore mentioned, elongated fasteners 43 comprise multiple sections 30 of ⅜ inch diameter steel rod threaded at both ends 51, 52 and are coupled into elongated fasteners 43 at assembly of portable building 10 with coupling nuts 31. Preferably, threaded rods 30 are about seven feet in length though any length could be used as long as the length thereof does not interfere with the construction of portable building 10. Threaded ends 51, 52 preferably have the same hand of thread in order to facilitate squaring and tightening of elongated fasteners 43 from either end. It has been found by the inventor hereof that squaring portable building 10 is best accomplished by threading elongated fasteners through all aligned holes 94 in webs 44 and through corner end panels 20 with wrench nuts 32 disposed on terminal ends 151, 152 rather than employ turnbuckles for coupling nuts 31 as wrench nuts 32 are easily accessible at each of corners 145 of portable building 10 and thus portable building 10 may be squared by simply tightening or loosening wrench nuts 32 at each corner 145 successively. It is usually beneficial to tighten all elongated fasteners 43 after completion of all erection, including roofing, with elongated fasteners 43 inserted through holes 94, 102, 103 with wrench nuts 32 loosely threaded on terminal ends 151, 152 in order to allow for some movement between studs 12, 28, wall panels 11, 20, 27, rafters 16, 26 and roof panels 15 throughout erection. Additionally, it has been found by the instant inventor that wrench nuts 32 may be disposed on ends 151, 152 with handles 146 turned upwardly and used for outside storage. Though coupling nuts 31 are not turnbuckles but merely couplers to engage threaded ends 51, 52, the use of turnbuckles for coupling nuts 31 is not excluded from the specification hereof as it is merely an engineering choice to substitute turnbuckles for coupling nuts 31 to mate with oppositely threaded ends 51, 52 on threaded rods 30.

Figure 18:
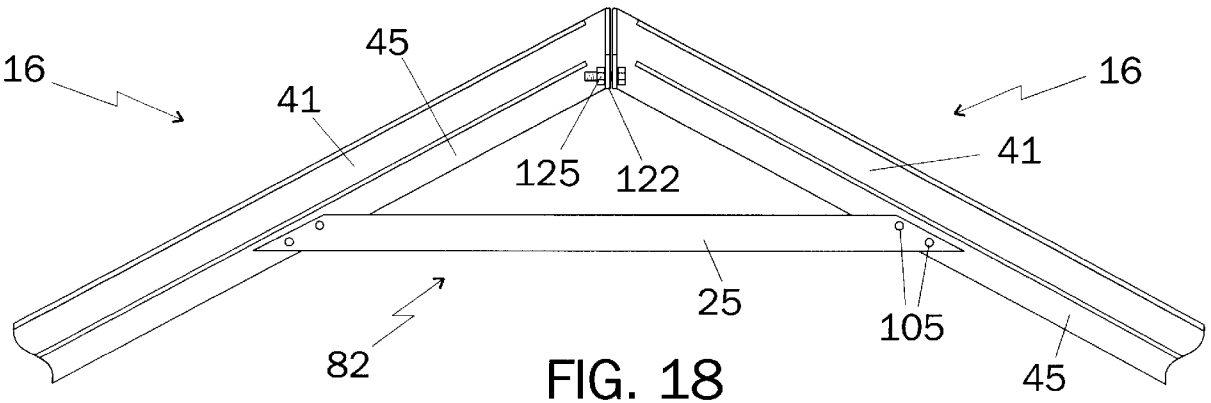
FIG. 18 is a greatly enlarged partial side plan view of a roof truss showing joining of the rafters at the ends thereof and with a collar tie spaced from the ends.
Figure 17:
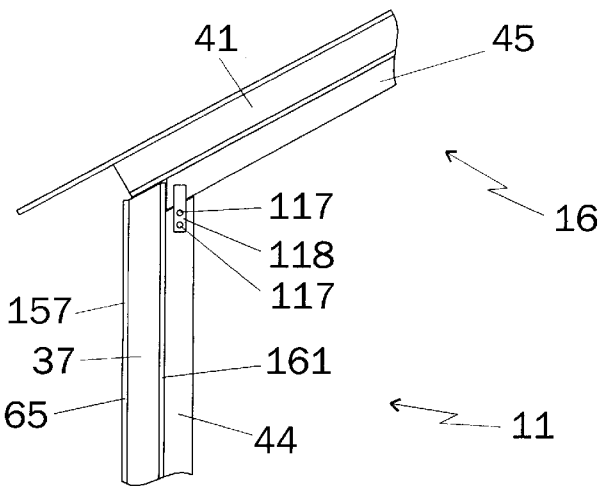
FIG. 17 is a greatly enlarged partial side plan view of the joint between roof rafters and wall studs of the portable building of FIG. 1.

Once walls 140–143 are erected and squared, roof trusses 82 as shown in FIG. 18 are erected over each pair of side wall studs 12 and over each end wall 140, 141. Referring also to FIGS. 10, 11, 13 and 17, roof trusses 82 may be made complete as in FIG. 18 wherein rafter end tabs 122 of intermediate rafters 16, or rafter end tabs 119 of end rafters 26 are joined by at least one bolt 125 passing therethrough. These trusses 82 are completed by spanning between webs 45 of intermediate rafters 16 with collar tie 25 and affixing collar tie thereto with bolts 125 through holes 105, 106. Similarly, webs 35 of end rafters 26 are joined with collar tie 25. After completion of an end truss 82 comprising two end rafters 26 and collar tie 25, channel 110 in end rafters 26 is lowered over top edge 104 of corner end panels 20 and top edges 133 of center end panel 27 with tabs 118 lying on the exterior of corner posts 17. Bolts 125 are then passed through holes 117 in tabs 118 and through holes 134 in corner post 17 and tightened to affix end rafters 26 firmly to corner posts 17. In a similar manner, intermediate trusses 82 are assembled by joining together end tabs 122 with bolts 125 passed through holes 121 in end tabs and assembling collar tie 25 to webs 45 by tightening bolts 125 passed through holes 105, 106 in collar tie 25 and web 45 of rafters 16 respectively. All trusses 82 may be assembled and laid aside for later placement over studs 12 or each truss 82 may be erected at the time each pair of roof panels 15 is raised into position. Alternately, each intermediate rafter 16 may be slid over edge 40 of roof panel 15 after roof panel 15 has been inserted into either end rafter channel 109 or another intermediate roof rafter channel 41. Additionally referring to FIGS. 1 and 6, once end rafters 26 have been placed over end panels 20, 27 and assembled to corner posts 17, one edge 40 of one roof panel 15 is inserted into roof channel 109 in one end rafter 26 on one side 142 and one edge 40 of another roof panel 15 is inserted into roof channel 109 in the other end rafter 26 on opposite side 143 and roof channels 41 of intermediate rafters 16 are moved into engagement with open edge 40 of roof panels 15 with tabs 113 of intermediate rafters 16 lying against the exposed side of web 44 of intermediate studs 12. Bolts 125 are then passed through aligned holes 116, 135 in tabs 113 and webs 44, respectively to join roof rafters 16 to side studs 12. Elongated fastener 43 is then passed through fastener holes 108 in each end rafter 26 and fastener holes 112 in the intermediate stud just assembled to roof panels 15. Construction of the roof of portable building 10 proceeds in like fashion until all intermediate rafters 16 are affixed to the corresponding pairs of intermediate studs 12 with roof panels 15 inserted in channels 41 of intermediate rafters 16. The final pair of roof panels 15 are hoisted into position one at a time and inserted into channel 41 in the last intermediate rafter 16. The outer edge 40 of each final roof panel 15 is then raised above corner end panel 20 and center end panel 27 and channel 109 of end rafter 26 is placed over outer edge 40. The assembly of end rafter 26 and roof panel 15 is then lowered over corner end panel 20 and center end panel 27 with channel 110 receiving upper ends 104 and 133 of corner end panel 20 and center end panel 27 respectively therein. Once lowered over upper ends 104 and 133, holes 117 in tab 118 are aligned with holes 134 in corner post 17 and bolts 125 are passed therethrough and tightened. Final lengths 30 of elongated fasteners 43 are inserted through holes 108 in end rafters 26 and joined to existing lengths 30 of elongated fasteners 43 protruding from intermediate rafters 16. Wrench handles 32 are threaded upon ends 152 of elongated fasteners 43 passing through roof rafters and tightened against the respective end rafter 26 thus clamping roof panels 15 into channels 41, 109. As portable building 10 has previously been squared during the construction of walls 140–143, tightening of elongated fasteners 43 through roof rafters 16, 26 is primarily for the purpose of retaining roof panels 15 in channels 41, 109. Those appreciating the novel features herein described will note that at least two of rafters 16, 26, 24 has at least one elongated fastener 43 passing through a web portion 45, 35, 173 respectively, and at least two of upright posts 12, 28, 23 has another elongated fastener 43 passing through a web portion 44, 99, 127 respectively of each upright post 12, 28, 23 wherein the one elongated fastener 43 is removably holding roof panel 15 in channel 41, 109, 175 respectively, between the respective rafters 16, 26, 24 and the another elongated fastener 43 is removably holding wall panels 11 in channel 37, 98, 128 respectively, between the respective upright posts 12, 28, 23.

Now referring back to FIG. 1, a ridge cap 34 is applied to portable building 10 in elongated sheets 138, each ridge cap section 138 joined to portable building 10 by bolts 70 passing through top surface 83 of a cap bracket 71 and secured inside portable building 10 adjacent roof panels 15. Ridge cap sections 138 are overlapped at end 139 a few inches with cap bolt 70 inserted through a sealing washer 69 then through cap bracket 71, another sealing washer 69 then through holes 144 in both sections 138. Bolt 70 extends downwardly between adjacent ends 153 of roof panels 15 and is inserted through cap tie 72 and secured thereto with a wingnut. Cap tie 72 spans across between.adjacent ends 153 of roof panels 15 and bears against the inside surface 147 thereof thus securely holding roof cap 34 to roof panels 15 of portable building 10. Door hardware, not shown, is then added to door 21 to permit entry and exit thus completing construction of portable building 10. Preferably, ridge cap sections 138 are seven foot long pieces of 18 gauge galvanized sheet metal bent at an included angle of 48 degrees thus forming a V-shaped section conforming to the roof of portable building 10. Bolt holes 144 are provided at 3 inches from each end 139 such that sections 138 may be overlapped six inches and secured together to roof panels 15 with bolts 70, washers 69, cap bracket 71 and cap tie 72.

Studs 12, 28 and intermediate rafter 16 are constructed of CRS sheet steel. Referring to FIGS. 5, 8, 11 and 17, outer flange 157 is one section of 3 inch wide, ⅛" thick CRS and has another section of 3 inch wide, ⅛" thick CRS welded to one side in the center thereof comprising web 44, 99. Channels 37, 98 and 41 are formed by welding 1½" wide flanges 161 of ⅛" thick CRS on both sides of web 44, 99 and 45 spaced from outer flange 157 approximately 1⅝" to accommodate panels 11, 15, 20 and 27 therein. Thus, studs 12, 28 and intermediate rafter 16 comprise a "double T" cross section wherein one "T" is place on the top of another "T" with the space between the cross bars of the "T"s comprising channels 37, 41 & 98. Studs 12, 28 have tabs 91, 100 respectively, welded to outer flange 157 depending from the lower ends 93, 97 thereof, respectively. Tabs 91, 100 are provided with at least one hole 92, 101 respectively, for receiving a lag bolt therethrough for attaching lower ends 93, 97 to floor supports 14. Top 95 of intermediate stud 12 is cut at an angle 162 of 66 degrees along the length of web 44 through the thickness of flanges 157, 161 and are adapted to have inside surface 147 of roof panels 15 rest thereon. End studs 28 are also cut at angle 162 of 66 degrees, however, end studs 28 have angle 162 disposed across the width of flanges 157, 161 from one side to another, one end stud 28 of each pair having top end 132 cut across the width of flanges 157, 161 in the opposite direction. Angle 162 is complementary to the slope of the roof of portable building 10 and is thus 66 degrees. End studs 28 may also be constructed without tab 100 and thus used as room divider studs when constructing a room divider as hereinafter described.

Intermediate rafter 16 has tab 113 welded to web 45 at one end 163, tab 113 extending at an angle of 66 degrees from the plane of flanges 157, 161 such that tab 113 lies in the plane of flanges 157, 161 of side wall studs 12. Flange 157 of intermediate rafter 16 extends beyond tab 113 and flange 161 as the extending portion of flange 157 and roof panel 15 comprise an eave for the roof of portable building 10. Central web 45 of intermediate rafter 16 extends beyond flanges 157, 161 at the end opposite end 163 and is bent at a 90 degree angle to web 45 creating rafter end tab 122. Rafter end tab 122 is provided with at least one bolt hole 121 for joining intermediate rafter 16 to its opposing intermediate rafter 16. Each pair of intermediate rafters 16 is identical except for rafter end tab 122, rafter end tab 122 extending from opposite sides of web 45 in the opposing pairs.

Referring now to FIG. 9, corner post 17 is made from two sections of 3 inch wide, ⅛" thick CRS welded together at 90 degrees. Top end 164 is cut at angle 162 through the thickness of one flange 166 and across the width of the other flange 167 for one pair of opposite corners 145 but cut through the thickness of other flange 167 and across the width of one flange 166 for the other pair of corners 145. Bottom end 165 has a tab 90 welded to one flange 166 for one pair of opposite corners 145 and welded to other flange 167 for the other pair of corners 145. Each tab 90 has at least one hole 86 therethrough for receiving a lag bolt therein to attach corner post 17 to end support members 14.

End rafters 26 are likewise manufactured from CRS sheet steel. Referring to FIG. 10, end rafters 26 are first constructed similar to corner posts 17 by affixing upper flange 168 of a section of 3 inch wide, ⅛" thick CRS to another section of 3 inch wide, ⅛" thick CRS at 90 degrees. Thereafter, a ceiling flange 170 of 3 inch wide, ⅛" thick CRS is affixed to outer flange 169 in the center thereof parallel to upper flange 168 to provide for channel 109, channel 109 adapted to receive roof panel 15 therein. Spaced inwardly along ceiling flange 170 parallel to outer flange 169 a 1½" wide section of ⅛" thick CRS comprising web 35 is affixed to ceiling flange 170 on the side of ceiling flange opposite channel 109 thus forming channel 110 between outer flange 169 and web 35, channel 110 adapted to receive upper edges 104, 133 of end panels 20, 27 respectively, therein. Tab 118 is affixed to outer flange 169 and has holes 117 therein for affixing same to corner post 17 and side wall panel 11 at corners 145. Preferably, wood screws are inserted through holes 117 in tab 118 and holes 134 in corner posts, these wood screws driven into side wall panel 12. Top end tab 119 is affixed across an open end 180 of channel 109, top end tab 119 having top end tab holes 120 disposed therethrough for receiving bolts 125 therein to affix mating pairs of end rafters 26 over ends 140, 141 of portable building 10. Top end tab 119 and tab 118 are disposed at angle 126 with respect to upper flange 168.

Figures 4, 6, 7:
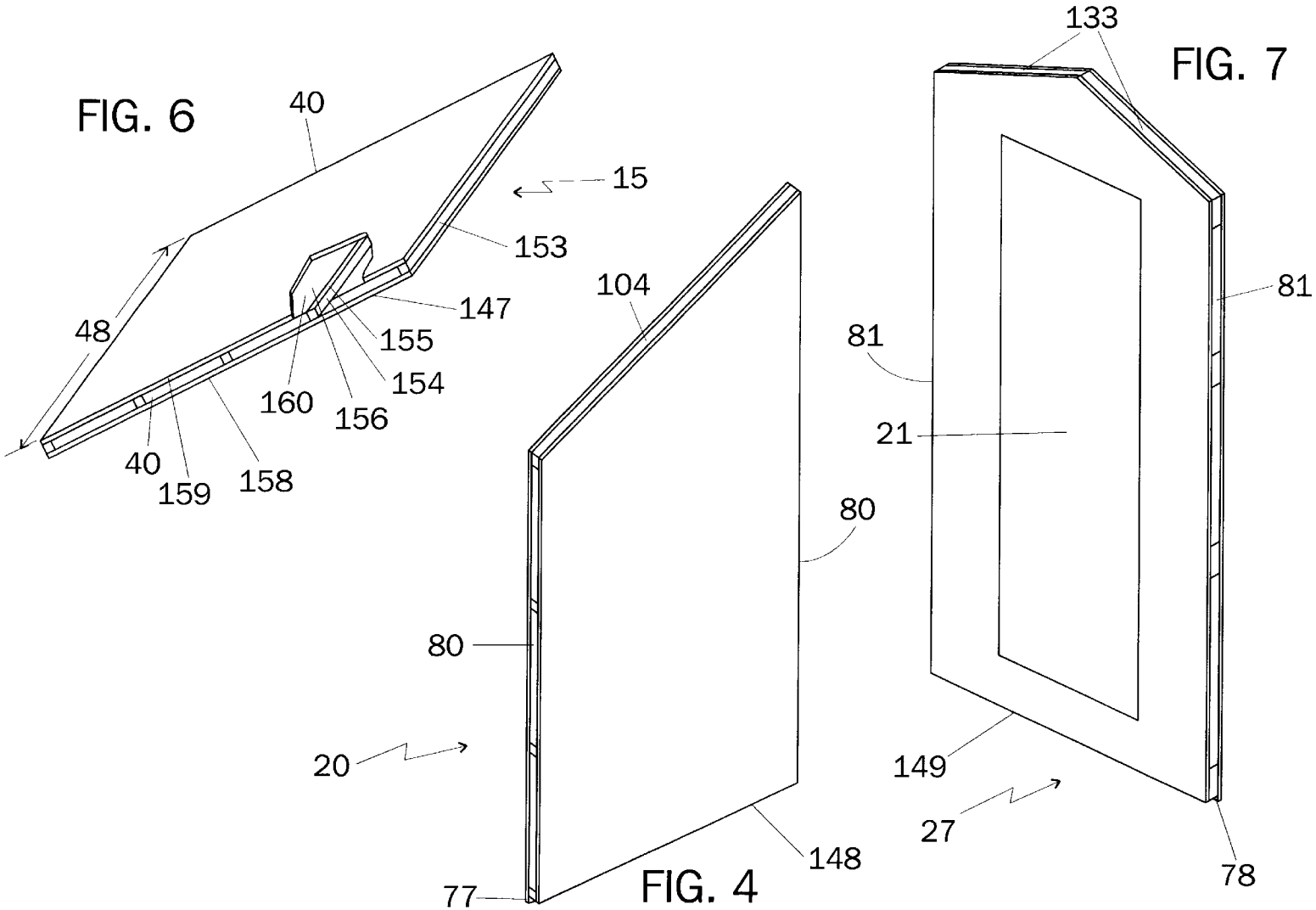
FIG. 4 is an enlarged perspective view of an angled end wall panel of the portable building of FIG. 1.
FIG. 6 is a enlarged perspective view of one roof panel of the portable building of FIG. 1.
FIG. 7 is an enlarged perspective view of a center end panel of the portable building of FIG. 1.
Figure 15:
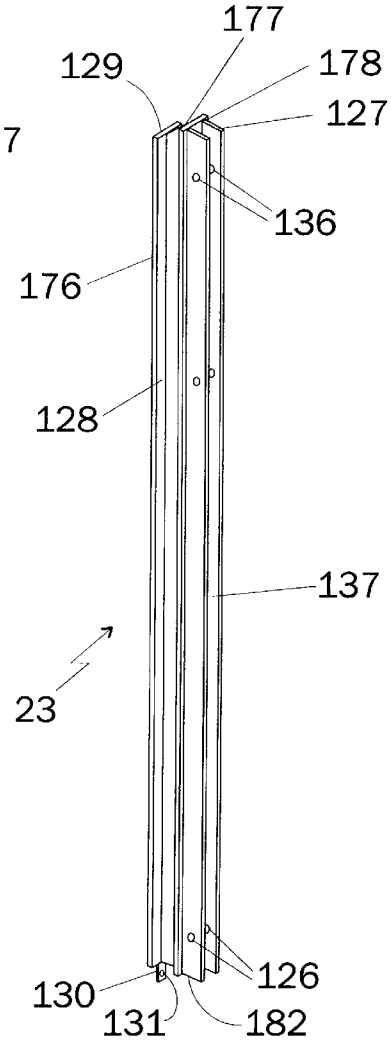
FIG. 15 is a enlarged perspective view of a room divider wall stud of the portable building of FIG. 1.
Figure 8:
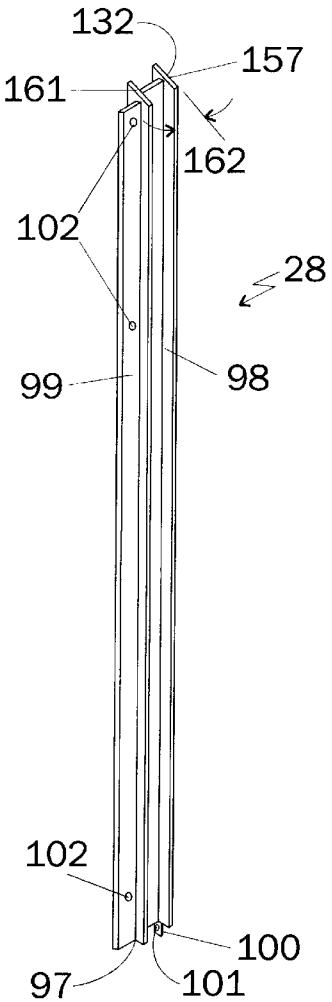
FIG. 8 is a enlarged perspective view of an end wall stud of the portable building of FIG. 1.
Figure 5:
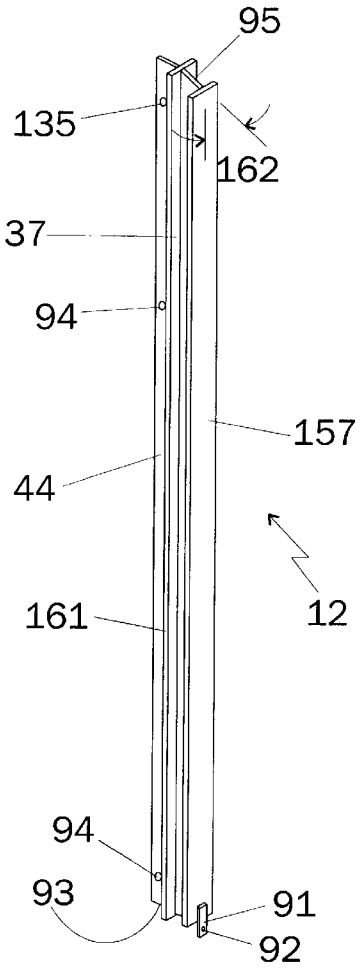
FIG. 5 is an enlarged perspective view of a side wall stud of the portable building of FIG. 1.

Referring now to the broken away portions of roof panel 15 in FIG. 6, the construction of wall panels 11, roof panels 15 and end panels 20, 27 is substantially the same wherein a wood frame 154 with wood cross pieces 155 having structural Styrofoam pieces 156 therebetween is sandwiched between outer skins 158, 159. Thus, wall panels 11, roof panels 15 and end panels 20, 27 are constructed of an outer structural skin 159 separated from an inner structural skin 158 by an insulating core 160, the thickness 66 of panels being about 1⅝". Preferably, inner and outer structural skins 158, 159 respectively are identical and are ⅜" thick plywood and insulating core 160 is structural Styrofoam, however, all panels 11, 15, 20 and 27 could be made entirely of structural Styrofoam or another free standing insulating material without departing from the scope of this invention. Alternately, all panels 11, 15, 20 and 27 may have a rigid thermoplastic, thermosetting or metallic material for either or both inner and outer structural skins 158, 159 respectively. A steel bar (not shown) may be affixed to at least one of cross pieces 155 and/or frame 154 to provide greater strength to panels 11, 15, 20 and 27. It has been found by the instant inventor that the side load of portable building 10 exceeds a load equivalent to an 80 mile per hour wind and roof panels 15 easily support a roof load of 40 pounds per square foot. Wall panels 11, 20, 27 of portable building 10 thus comprise side wall panels 11 and end wall panels 20, 27 side wall panels 11 being substantially identical is shape, size and construction, end panels 20, 27 comprising a right hand corner panel 20 and a left hand corner panel 20 of mirror construction and center end panel 27 of construction substantially the same as side panels 11 wherein center end panel 27 has an overall length of less than eight feet. Side wall panels 11 have top edge 79 cut from inside surface 147 to outside surface 65 at angle 126 of 66 degrees with respect to inside surface 147. Corner end panels 20 are cut at angle 126 from one side edge 80 to the other side edge 80 along top edge 104.

At least one wall panel, 11, 20, 27 has a door 21 therein wherein door 21 is cut from wall panel 11, 20, 27 and thereafter hinged thereto, preferably, at least one wall panel 11, 20, 27 also has a window 22 disposed therethrough, window 22 being of simple but functional construction. As door 21 is cut from wall panel 11, 20, 27, wall panel 11, 20, 27 has an opening for door 21 disposed through skins 158, 159 wherein edges of the opening are closed with frame work similar to frame 154. Door 21 has a means for sealing the edges thereof against the opening disposed in wall panel 11, 20, 27. Preferably, each center end panel 27 has door 21 disposed therethrough as center end panel 27 is up to eight feet in height and thus at least a 6' high, 2'6" wide door may be cut therefrom. Frame 154 is constructed from materials selected from the group comprising wood, steel, aluminum, thermoplastics or combinations thereof. For instance, frame 154 may be a wood frame clad with steel channel or alternately a wood/thermoplastic composite material, though preferably, frame 154 is constructed of 1×2 furring strips. Likewise, cross pieces 155 are constructed from materials selected from the group comprising wood, steel, aluminum, thermoplastics or combinations thereof Portable building 10 may be divided into separate rooms by replacing opposing pairs of upright studs 12 with room divider studs 23 and corresponding intermediate rafters 16 with room divider rafters 24. Room divider panels (not shown) are substantially the same as end panels 20, 27, however, flanges 77, 78 are not provided as room divider panels are adapted to have corresponding ends 148, 149 of end panels 20, 27 rest upon floor panels 13. The room divider panels may also be provided with windows 22 and preferably the center room divider panel has a door 21 disposed therein. In one embodiment, at least one room divider panel is installed in room divider studs 23 and room divider rafters 24 adjacent at least one outer side 142, 143 and may be provided adjacent both outer sides 142, 143. The use of room divider studs 23 and room divider rafters 24 with room divider panels is up to the discretion of the builder of portable building 10. For instance, in one embodiment, room divider panels may be used to terminate the closed in space of portable building 10 short of one end 140, 141 wherein at least one, preferably all, of the remaining wall panels 11, 20, 27 is a screened frame thus providing a screened porch to portable building 10. The screened portions of wall panels 11, 20, 27 thus provided may comprise the entirety of the framed structure or be only a part thereof Thus it is possible to erect a portable building 10 comprising a plurality of wall panels 11, 20, 27, a plurality of upright posts 12, 17, 28, a plurality of floor panels 13, a plurality of floor support members 14, a plurality of roof panels 15, a plurality of rafters 16, 26, at least one room divider stud 23, at least one room divider rafter 24 and at least one room divider panel wherein an edge 36 of each wall panel 11, 20, 27 is captured in a channel 37, 98, 128 of upright posts 12, 17, 28 respectively, an edge of each roof panel 15 is captured in a channel 41, 109, 175 in one of the plurality of rafters 16, 26, 24 respectively, and wherein the plurality of rafters 16, 26, 24 are joined together in opposing pairs at a common joint.

Room divider studs 23 have two divider flanges 127 affixed to an inside flange 178 and thus web 177 is a ½" wide section of ⅛" thick CRS welded at a right angle to outside flange 176 in the center thereof Inside flange 178 is then welded to the open end of web 177 at the center thereof, inside flange 178 disposed parallel to outside flange 176. Divider flanges 127 are then spaced equally on either side of the center line passing through web 177 and welded to inside flange 178 thus creating channel 137, channel 137 adapted to receive the edge of a room divider panel therein, this edge corresponding to edge 80 of corner end panel 20. Room divider stud 23 thus has three channels 128, 137 wherein room divider channel 137 is disposed at a right angle to wall channels 128. Flanges 127 are provided with fastener holes 126 for receiving elongated fasteners 43 therein in the same manner as provided for wall studs 12. Room divider stud 23 also has tab 130 extending from the lower end thereof, tab 130 having lag bolt hole 131 therein for affixing room divider stud 23 to floor support 14.

Room divider rafters 24 are similar to intermediate rafters 16 except channel 174 is provided between wall flanges 173 and therefore roof divider rafter 24 has a web 172 of 1½" wide section of ⅛" thick CRS welded to the center of exposed flange 171 and to the center of intermediate flange 179, intermediate flange 179 and exposed flange 171 formed from 3" wide sections of ⅛" thick CRS. Wall flanges 173 are then spaced equally on either side of the center line passing through web 172 and welded to intermediate flange 179 thus creating channel 174, channel 174 adapted to receive the top edge of room divider panels therein, this edge corresponding to top edges 104, 133 of corner end panel 20 and center end panel 27 respectively. Flanges 173 have elongated fastener holes 111 disposed therethrough, elongated fastener holes 111 aligning with holes 112 and 108 of intermediate rafters 16 and end rafter 26 respectively. Each wall flange 173 has a tab 115 welded to the end thereof disposed at angle 126 with respect to intermediate flange 179, tabs 115 having holes 114 therein for joining room divider rafter 24 to room divider stud 23. In like manner to end rafters 26 and intermediate rafters 16, room divider rafter 24 has rafter end tab 123 welded to the open end of exposed flange 171 and intermediate flange 179 with bolt holes 124 drilled therethrough for receiving joining bolts 125 thereby joining opposing pairs of room divider rafters 24 together at the peak of portable building 10.

Collar tie 25 is a 3" wide sections of ⅛" thick CRS cut on both ends at angle 107, angle 107 on one end thereof cut opposite angle 107 on the opposite end thereof. Angle 107 is 24 degrees with respect to the longitudinal axis of collar tie 25 and thus corresponds to the pitch of the roof of portable building 10. Collar tie 25 has tie bolt holes disposed in both ends thereof adapted to receive bolts 125 therethrough when joining any pair of rafters 16, 24, 26 together during construction of portable building 10.

Floor joints 29 are 1½" wide sections 181 of ⅛" thick CRS spaced apart by a web 89, web 89 being formed from ¾" wide section of ⅛" thick CRS. Web 89 is welded into the center of sections 181 thus creating two channels 39 of equal size on opposite sides of web 89, channels 39 receiving floor panels 13 therein during construction.

Portable building 10 comprising a plurality of wall panels 11, 20, 27, upright studs 12, 28, floor panels 13, floor support members 14, roof panels 15, rafters 16, 26, truss collar ties 25 and elongated fasteners 43 are sized to be transported in the bed of a standard pickup truck, erected on one building site, used for living quarters at the site, disassembled at the one building site, transported in the pickup truck to a new site and erected on the new site. Specifically, as center end panel 27 is the longest member at just under eight feet, all panels 11, 13, 15, 20, 27 may be laid flat in the pickup bed with rim joist 50, rafters 16, 26, wall studs 12, 28, corner posts 17, floor joints 29, jacks 150, elongate fasteners 43, floor supports 14 and collar ties 25 occupying spaces within the pickup bed not occupied by panels 11, 15, 20, 27. The arrangement of panels 11, 13, 15, 20, 27 are stacked essentially in reverse order of assembly of portable building 10. For instance, roof panels 15 are laid flat on the floor of the bed of the pickup truck between the wheel wells and as this distance is greater than the four foot width 48 of roof panels 15, roof rafters 16, 26 may be laid alongside roof panels 15 extending lengthwise along the bed of the pickup truck. End panels 20, 27 from one end 141 may then be stacked upon roof panels 15 with end wall studs 28 laid alongside thereof. Side wall panels 11 are then stacked crosswise across the top of the rails of the pickup bed supported also by roof panels 15 and end panels 20, 27 from end 141 as the stack height of end panels 20, 27 and roof panels 15 is substantially the same as the depth of the bed of the pickup truck. As side panels 11 are substantially four feet in length, each layer thereof comprises two side panels with edges 36 abutting. End panels 20, 27 of end 140 are then stacked upon side panels as disassembled, with studs 12, 28 inserted alongside the stack of roof panels 15 on the top of one of the wheel wells. Floor panels 13 are then stacked upon end panels 20, 27 of end 140 and floor supports 14 laid alongside of panels 13, 20, 27. Each rim joist 50 is then disassembled into its three sections and inserted lengthwise into the pickup bed on top of the opposite wheel-well. Finally, after disassembly of portable building 10, all elongated fasteners 43, including threaded rods 30, coupling nuts 31 and wrench nuts 32 are inserted into a 4" diameter thermoplastic pipe, the pipe capped on both ends and inserted lengthwise into the pickup bed alongside rim joist sections, 18, 19. Bolts 125 with wingnuts and wrench handles are gathered into a container and placed at the back of the bed of the pickup. The tail gate is closed and the stack of materials is bound to the bed in a manner consistent with transportation. As the stack height is less than the height of the cab of the pickup truck and all materials are contained within the dimensions of the bed of the pickup truck, no special transportation permits are required. Portable building 10 may be erected at a one building site in less than 6 man-hours by one person and considerably less than 6 man-hours by two or more persons.

In an alternate construction of portable building 10 and as is inferred in FIG. 1, construction of one end 140 may be fully accomplished by screwing together one corner end panel 20 to side wall panel 11 at one corner 145 of end 140 and thereafter proceeding across end 140 having end studs 28 inserted between center end panel 27 and corner end panel 20 into channels 98 in end studs 28. Side panel 11 adjacent other corner end panel 20 is also joined thereto by wood screws. Comer posts 17 are joined to each corner 145, end roof rafters 26 erected over end panels 20, 27 and elongated fasteners 43 inserted through holes 102, 103 in end posts 28 and corner posts 17 of end 140. Construction then proceeds down both sides 142, 143 simultaneously by inserting side posts 12 between side wall panels 11 in channels 37 in side posts 12 and roof panels 15 into channels 41 of intermediate rafters 16 as shown in FIG. 1. End 141 is then erected and roof cap 34 applied as hereinbefore described. Thus, portable building 10 comprises a plurality of wall panels 11, 20, 27 with a plurality of upright posts 12, 28 therebetween, a plurality of floor panels 13 having a plurality of floor joints 29 therebetween, the plurality of floor panels 13 and plurality of floor joints 29 lying.flat upon a plurality of floor support members 14 and a plurality of roof panels 15 having a plurality of rafters 16, 26 therebetween wherein the plurality of wall panels 11, 20, 27 have ends 64, 148, 149 respectively resting on the plurality of floor-panels 13 and the plurality of upright posts 12, 28 have ends 93, 97 respectively resting upon the plurality of floor panels 13.

In another alternate construction, sides 140–143 may be first constructed as hereinbefore described with all roof rafters 16, 26 erected thereabove. Before tightening elongated fasteners 43 passing through holes 112, 108 of roof rafters 16, 26 respectively, roof panels 15 are inserted into channels 109, 41 between adjacent rafters 16, 26 and pushed upwardly to substantially butt together at the top of portable building 10. Once interfitted with channels 41, 109, friction generally holds roof panels 15 in place until elongated fasteners 43 are tightened. Roof cap 34 is then applied as hereinbefore described. Thus, portable building 10 comprising a plurality of wall panels 11, 20, 27, a plurality of upright posts 12, 28, a plurality of floor panels 13, a plurality of floor support members 14, a plurality of roof panels 15, a plurality of rafters 16, 26 has the plurality of wall panels 11, 20, 27 interfitted with the plurality upright posts 12, 28 and the plurality of roof panels 15 interfitted with the plurality of rafters 16, 26, the plurality of wall panels 11, 20, 27 having ends 64, 148, 149 respectively resting on the plurality of floor panels 13 wherein the plurality of floor panels 13 are lying flat upon the plurality of floor supports 14.

Though bolts have been used throughout for joining members together, other means of joining is within the scope of this invention. For instance,joints may be made with bed rail button & slide, tab fitted into a socket, pop rivets, clevis pin, stud and toggle pin as well as other devices as desired by the user. Furthermore, though bolts 125 with wing nuts are preferably used to join rafters to studs and opposing rafters together at their common ends, elongated fastener 43 may be passed through rafters 16, 24, 26 and upright posts 12, 28 respectively, at a common joint between rafters 16, 24, 26 and the respective upright post 12, 28 to affix rafters 16, 24, 26 to their respective upright posts 12, 28, 23 while holding wall panels 11, 20, 27 in channels 37, 98, 128 of upright posts 12, 28, 23 respectively and holding roof panels 15 in channels 41, 109, 175 of rafters 16, 26, 24 respectively.

In another embodiment, all studs 12, end posts 28, and corner posts 17 may be of the same cross section as side posts 12 and joined with angled flat tabs either rigidly affixed to one stud 12, 28 or post 17 or as separate pieces. This alternate construction leaves an open channel pointing outwardly at corners and requires that end panels 20, 27 be fitted to the outside of web 44. A flat strap or large washer could then be used to bear against wrench nuts 32. Construction of panels 11, 15, 20 and 27 need not change with this alternate construction. In yet another embodiment, floor joints 29 are also made with the same cross section as side posts 12 and used as floor supports 14 with web 44 extending downwardly. Modifications to rim joist 50 to accommodate these floor joints is a matter of choice and well within the skills of most readers hereof.

In the preferred embodiment, studs 12, 28, corner posts 17 and rafters 16, 26 are made of one eighth inch thick steel strap iron and welded together in the configurations shown in FIGS. 5 and 8–12 though these units could be extruded channels of aluminum or aluminum alloys, titanium or titanium alloys, iron or iron alloys or molded of a high strength polymer or polymer/fiber composite.

In still another embodiment, elongated fasteners 43 may be adapted to pass through at least the junctures of the wall studs 12, 28 and rafters 16, 26 by cutting wall studs 12, 28 and rafters 16, 26 with web portions 44, 99 adapted to overlap web portions 45 and 35 respectively. In this embodiment coupling nuts 31 are used to secure studs 12, 28 and rafters 16, 26 respectively, together though it has been found by the instant inventor that the preferred method of construction is more efficient and less labor intensive.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A portable building comprising a plurality of wall panels, a plurality of upright posts, a plurality of floor panels, a plurality of floor support members, a plurality of roof panels, and a plurality of truss members, each said truss member comprising a pair of opposing rafters and a collar tie, wherein an edge of each of said plurality of wall panels is captured in a channel in one of said plurality of upright posts, an edge of each of said plurality of roof panels is captured in a channel in one of said plurality of rafters, said plurality of rafters joined together in opposing pairs at the common end thereof and further joined together with said collar tie spaced from said common end, said plurality of floor panels supported on said plurality of floor support members, said plurality of floor support members supported in receiving sockets affixed to a rim joist plate extending alone opposing sides of said portable building, wherein said plurality of upright posts are affixed to alternate ones of said floor support members and said rim joist plate.

2. A portable building as in claim 1 wherein said pluralty of upright posts each have an elongated lag bolt passing through an appended tab on the lower end thereof and through a preformed hole in said rim joist into said alternate ones of said floor suppwort members.

3. A portable building as in claim 1 wherein said wall panels comprise side wall panels and end wall panels, said side wall panels being substantially identical is shape, size and construction, said end panels comprising a right hand, left hand and central panel of identical internal construction, said center panel having an overall length of less than eight feet.

4. A portable building as in claim 3 wherein said wall panels have an outer structural skin extending below a bottom surface of said wall panel adapted to be captured between an outer rim joist plate of said portable building and a contiguous one of said floor panels and wherein an inner structural skin is adapted to rest on an upper surface of said one of said floor panels.

5. A portable building as in claim 1 wherein said alternate floor support members are affixed to said rim joist plate.

6. A portable building as in claim 1 wherein at least two of said plurality of rafters has at least one elongated fastener passing through a web portion of each said rafter and at least two of said plurality of upright posts has another elongated fastener passing through a web portion of each said upright post, said one said elongated fastener removably holding said roof panel in said channel and between said two rafters and said another elongated fastener removably holding said wall panel in said channel and between said two upright posts.

7. A portable building as in claim 6 wherein said one said elongated fastener passes through one of said rafters and one of said upright posts at a common joint between said one of said rafters and said one of said upright posts and through another of said rafters and another of said upright posts at a common joint between said another of said rafters and said another of said upright posts.

8. A portable building as in claim 3 wherein said construction comprises an outer frame with cross pieces disposed between the edges thereof, structural foam pieces disposed between said cross pieces, said structural foam extending to said outer frame, said frame, said cross pieces and said structural foam sandwiched between outer skins.

9. A portable building as in claim 8 wherein said frame is constructed from materials selected from the group comprising wood, steel, aluminum, thermoplastics or combinations thereof.

10. A portable building as in claim 8 wherein said cross pieces are constructed from materials selected from the group comprising wood, steel, aluminum, thermoplastics or combinations thereof.

* * * * *